United States Patent [19]

Kaufmann et al.

[11] Patent Number: 4,634,078

[45] Date of Patent: Jan. 6, 1987

[54] ROPE GUIDE

[75] Inventors: Karl-Ernst Kaufmann, Wetter; Josef-Paul Saeftel, Castrop; Harald Bitsch, Witten; Otto Oldewurtel, Hagen, all of Fed. Rep. of Germany

[73] Assignee: Mannesmann Ag, Duesseldorf, Fed. Rep. of Germany

[21] Appl. No.: 744,515

[22] Filed: Jun. 13, 1985

[30] Foreign Application Priority Data

Jun. 13, 1984 [DE] Fed. Rep. of Germany ..... 3421843

[51] Int. Cl.[4] ..... B65H 54/28

[52] U.S. Cl. ..... 242/158 R; 242/158.2

[58] Field of Search ..... 242/158 R, 158.2, 54 R

[56] References Cited

U.S. PATENT DOCUMENTS

| | | | |
|---|---|---|---|
| 1,782,358 | 11/1930 | Lang | 242/158 R |
| 1,973,446 | 9/1934 | Rosenquist | 242/158 R |
| 3,226,090 | 12/1965 | Sauerbrey | 242/158.2 X |

FOREIGN PATENT DOCUMENTS

| | | | |
|---|---|---|---|
| 800244 | 10/1950 | Fed. Rep. of Germany | 242/158.2 |
| 1756614 | 4/1970 | Fed. Rep. of Germany | 242/158 R |
| 2732108 | 1/1978 | Fed. Rep. of Germany | 242/158.2 |
| 108153 | 2/1966 | Norway | 242/158 R |
| 2061861 | 5/1981 | United Kingdom | 242/158 R |
| 595249 | 2/1978 | U.S.S.R. | 242/158.2 |

*Primary Examiner*—Stanley N. Gilreath

*Attorney, Agent, or Firm*—Ralf H. Siegemund

[57] ABSTRACT

A rope guide having a threaded guide segment and a threaded holding segment with a holddown device covering at least a part of a single rope loop on a grooved drum; the segments are made of a synthetic material and their threadings engage the groove of the drum; a slot forming element is fastened to the guide segment and the rope runs through the slot towards the drum; roller mounts are mounted by a pin on the guide segment and carry spring biased rollers forcing the rope into the drum groove.

14 Claims, 5 Drawing Figures

ROPE GUIDE

BACKGROUND OF THE INVENTION

The present invention relates to a rope or cable guide to be used in cooperation with a winch drum or the like whereby the cable passes through a slot in the guide and a hold down structure causes the rope to lodge in suitable grooves in the drum; moreover the rope guide will axially travel upon rotation of the drum being however secured against following the rotation itself.

A rope guide structure of the type generally referred to above is disclosed for example in Swiss Pat. No. 220,559 showing also a roller to force the rope into the drum groove. The rope may lift off the groove, for example whenever a load hook or other equipment suspended by the rope or cable are intercepted by an object situated rather close to the drum. In accordance with German Pat. No. 2,316,930 such lifting of a rope out of the grooves is prevented by a clamping ring made of a synthetic material having however a rather large space requirement. The entire rope or cable covers six loops. Certain ring halves as they are used here, are made of steel and they are connected in the area of the rope guiding slot; nevertheless these steel halves taken individually are still quite heavy and expensive. A large weight is of course a detrimental feature that shows up particularly during assembly and disassembly for purposes of repair maintenance or the like. Moreover the connecting strap of the edge adjacent to the slot has sharp edges limiting oblique displacement of the cable but if in fact the angle from a vertical position is too large the rope can actually be damaged. Another drawback of this known structure is that the steel halves must be continuously greased for sliding in the grooves.

DESCRIPTION OF THE INVENTION

It is an object of the present invention to provide a rope guide construction which is of lighter weight, more economical and easier to assemble. Maintenance requirements should be low and the necessity of using a grease should be avoided. Moreover lateral deflections of the rope should be permitted without damage of any part including particularly the rope itself, and, finally, overall space requirement should be small without however interfering with the function of holding the rope on the drum.

In accordance with the preferred embodiment of the present invention the object is attained by providing a rope guide made of a synthetic material and is constructed to have a guide segment and a holding segment having a rope hold down device covering at least one rope loop section; moreover a guide loop is connected to the guide segment forming therewith a rope guiding slot while above the slot a roll or roller is journaled being urged by means of a spring for holding down the rope. The guide structure as a whole is guided for axial travel along the drum's periphery.

The length of the rope guide covers at the most five loops so that the length of the drum for a given hook displacement is shorter by one loop as compared with the device of the above mentioned German Pat. No. 2,316,930. The resiliently biased roll or roller forces the rope into the groove of the winch drum so that even as the rope is run in it will, under normal operating conditions, not slide under the roll and along the groove since the friction between rope and groove is large as compared to the resistance as between rope and roll. If still for some unforseen reasons the rope is lifted, the hold down device and the guide loop prevent the rope from being lifted further or even escape from the groove. The roller together with the rope hold down device and the guide loop or fork cover essentially the entire periphery of the drum, of course not in axial direction.

The synthetic used for cable and/or rope guide is preferably polyamide with a filler additive of MoS2. Polyamide 6.6 with a molybdenum disulphide filler is sufficiently strong and it has on the other hand an elasticity which permits even relatively large deformations without damage. Moreover the adding of MoS2 makes lubrication by means of grease or the like unnecessary. Consequently no grease and lubricants residue can fall for example from a crane and provide for some damage in food, clothing or the like.

The weight of the novel synthetic rope guide is only between 10 and 15% of the usual rope guide made of steel. Consequently it can be much easier assembled and mounted to the crane and the drum. This is a particularly important feature if mounting is to occur on older cranes or after repairs. The synthetic material mentioned above permits utilization within a temperature range from about −40 degrees Centigrade to about +100 degrees Centigrade. Through releasably fastening the guide loop to the guide segment and owing to the separation of the latter from the holding segment the rope guide can be released in a very simple manner so that the rope itself can be changed rather quickly.

In furtherance of the invention the guide segment and the holding segment have overlapping ends which are provided with bores to accomodate fastening bolts. Surface portions of the guide loop forms the rope entrance and a complementary surface of the guide segment establish rope guide ways having entrance inclinations permitting the rope to undergo lateral deflection corresponding to a ±4 degrees deviation from the vertical. If a still larger angle is to be expected one could provide a reinforcing angle made of steel and connecting the same to the guide loop at the side facing away from the slot. This reinforcing angle piece thus prevents undue bending of the synthetic guide loop. In such case rope deflections of up to ±10 degrees can be accommodated; the rope will bear against the obligue guideways at the entrance, slide thereon without damage on account of the particular material. Even in this case the guide segment will be forced into the rope grooves. Whenever the rope generally is deflected, the guide loop will deform until abutting against the rope itself. Guide segment and guide loop may be provided with recesses defining chambers which are limited by bars and being provided at those surfaces facing away from each other. This is another feature for saving material and weight and contributes to the elasticity of these components.

In furtherance of the invention a mounting pin or bolt is fastened to the guide segment for accommodating two roll mounts. These mounts are provided for journaling rolls which in turn are spring biased and urged against the rope at the end facing away from the mounting pin. These rolls are mounted in the U-shaped roll mounts leaving a certain axial space. This space permits shifting of the rolls in their respective mounts, and they thus automatically match variations in the groove pitch and roll position. Moreover the matching feature here has a compensating effect in case the rope is rather strongly inclined.

The roller mounts have support edges facing each other and provided with guides for the coil spring and against which the spring bears, and the spring automatically forces the rope, via the rolls or rollers into the groove. The rolls, the mounting pin, the roll mounts, the axle and the spring are made of steel. The rolls are hardened and mounted on the axles by means of roller bearings so that during winding and unwinding of the rope the rotational resistance is as low as possible.

The rope guide is guided on a rail of the winch as to axial displacement using a synthetic material cam guide or the like. Moreover the device is prevented this way from following the rotation of the drum. The guide cam has a transition portion to merge with the lower rope entrance guide way which cooperates with the upper guide way. These rope path limiting guide ways link the guide loop with the guide segment. This connection is traversed by a screw.

The particular material (MoS2) mentioned above permits utilization of the rope guide under extreme temperature conditions. The shape and particularly the formation of the rope guiding slot as well as the axial slidability of the rolls forcing the ropes into the grooves and finally the arrangement of the rope hold down device at the complementary guide segment are all configured so that even in case of an extraordinary angular deviation from the vertical of the rope there is no undue wear on the various parts and that of course is instrumental in avoiding interference with the overall operation.

DESCRIPTION OF THE DRAWINGS

While the specification concludes with claims particularly pointing out and distinctly claiming the subject matter which is regarded as the invention, it is believed that the invention, the objects and features of the invention and further objects, features an dadvantages thereof will be better understood from the following description taken in connection with the accompanying drawings in which:

Figure 1:
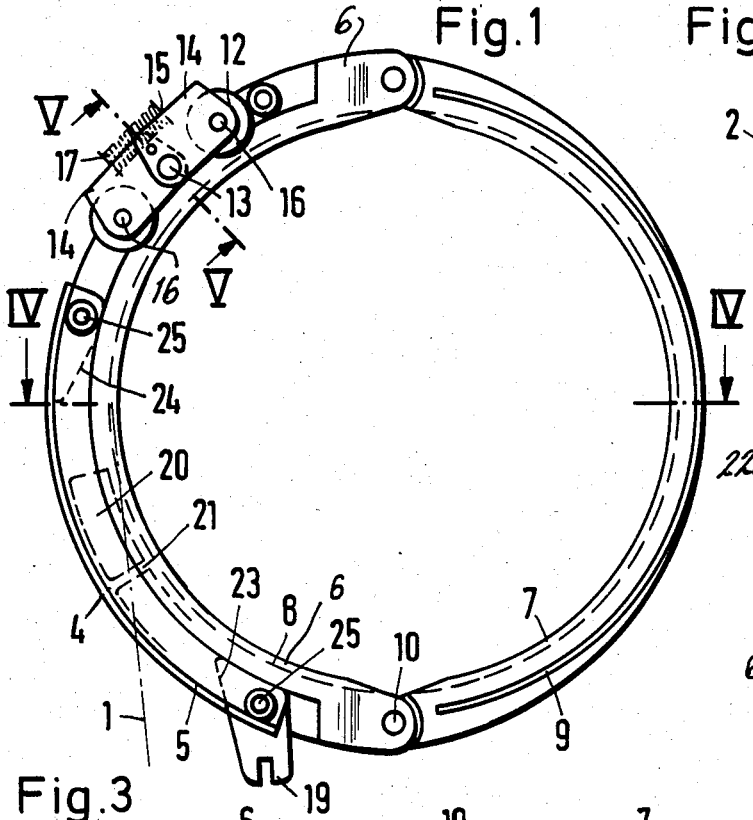
FIG. 1 is a top view of a rope guide constructed with the preferred embodiment of the present invention for practicing the best mode thereof.
Figure 4:
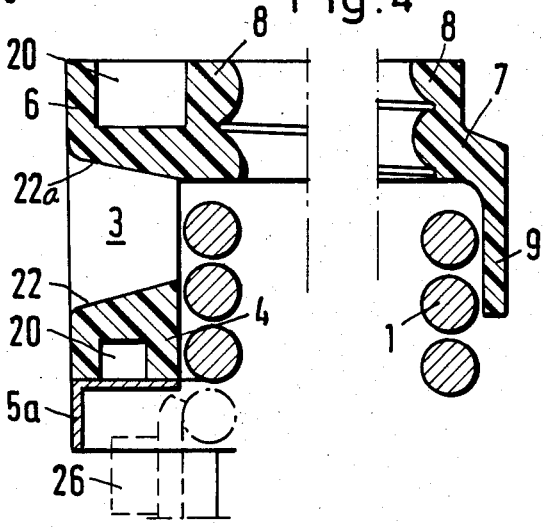
FIG. 4 is a section as indicated by IV—IV in FIG. 1.

Proceeding with the detailed description of the drawings the figures show a rope 1 indicated in dashed lines in FIG. 1, but in full in FIG. 4. This rope is guided during take-up by and in a grooved rope drum 2, and by means of a slot 3 in a current guide element 4. Element 4 is configured to have an axially offset portion relative to segment 6, to establish the slot 3, being bounded by surface portions 22*a*, 22, 23 and 24. This guide element or fork 4 is provided with a reinforcing angle piece 5 and is connected (screws 25) with a semiannular guide segment 6. The latter guide segment is connected with a holding segment 7 using overlapping ends 11 for accomodating fastening bolts 10.

The holding segment 7 as well as the guide segment 6 each have a threaded profile 8 for being guided in the grooves of the drum 2. The holding segment 7 has, in addition to the threaded profile 8 a rope hold down device 9 covering two loops of the rope 1 as shown in FIG. 4 and being situated adjacent to the drum 2 but on a side basically opposite to the guide slot 3. FIG. 1 shows the overall arrangement and FIG. 4 shows these details and it also illustrates that the reinforcing angle element 5 and particularly in the end position of the rope guidance extends with its leg 5*a* over and beyond a dash-dot illustrated rope clamp 26 of the drum 2. This combination of features, has the effect of reducing the effective width of the equipment which in turn means that for start-up the dimensions for fastening the rope are particularly small.

The rope 1 will be guided in and into slot 3 by lateral and inclined entrance ways 22 and 22*a*, by an upper also inclined limiting surface 24, and by a lower inclined surface 23, also (except 22*a*) pertaining to guide fork or element 4. Rolls or rollers 12 are arranged above at the guide segment 6. This way the rope will be guided towards the grooves in the drum 2. A mounting pin 13 is fastened to the guide segment 6. This pin 13 carries two roller mounts 14 with axial bearings on journal pins 16 on which are mounted and journaled the rollers 12.

The rollers 12 and the entire mounting arrangement as described thus far are biased by means of a spring 17 being a coiled spring and urging the rollers 12 against the incoming rope 1. The spring 17 bears, for purposes of stationary support, against support edges 15 of the two mounts 14, facing each other. Pins projecting from these support edges 15 establish the guide for the coil springs 17.

Figure 5:
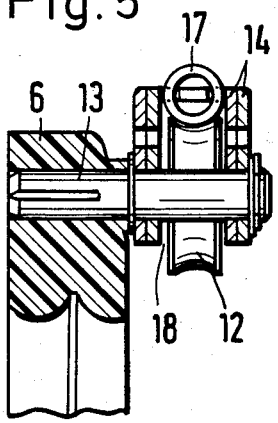
FIG. 5 is a section as indicated by V—V in FIG. 1.

In order to make sure that the rope 1 is properly urged into the respective grooves, even if the rope has an oblique disposition, spaces or gaps 18 are provided which, as shown in FIG. 5, are disposed between the rollers 12 on one hand and the walls of the U-shaped roll mounts 14 on the other hand. These spaces 18 provide a certain slack for the rolls 12 and permit shifting of them on their axles or journal pins 16. The guide segment 6 is usable for right hand as well as for left hand pitch type rope drums. For purposes of adaptation it is merely required to change the disposition of the roller mounts for the rolls 12 to the mirror image position.

Figure 2:
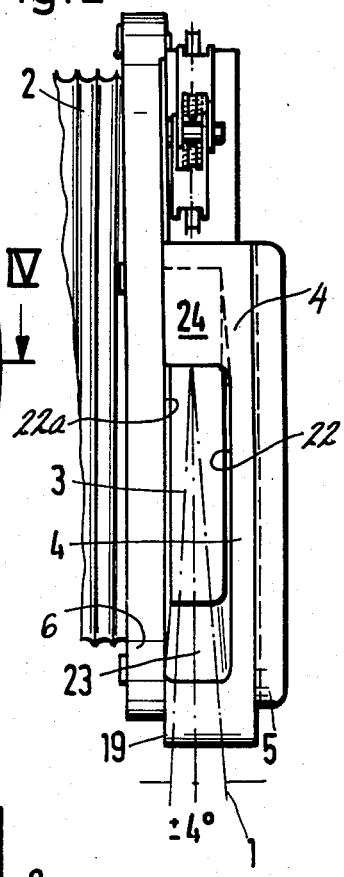
FIG. 2 is a side view of the device shown in FIG. 1.
Figure 3:
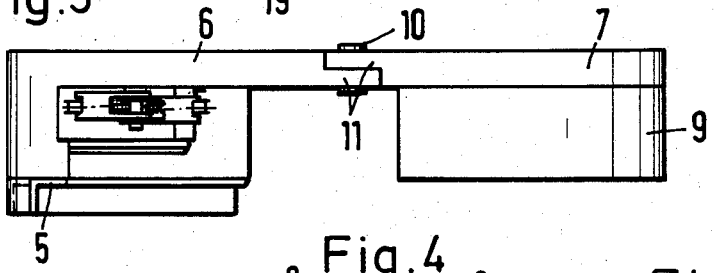
FIG. 3 is an edge-on view of the device shown in FIG. 1.

As the rope drum 2 turns, the entire rope guiding equipment moves axially corresponding to the sense of rotation and depending upon the orientation of the pitch of the grooves in the drum. This movement is the result of the threaded engagement between the grooves of the drum 2 on one hand and the threaded profiles 8 of the segments 6 and 7 on the other hand. Movement therefore is to the left or to the right as per FIG. 2. The rope guide is prevented from following the rotation of the drum by means of a claw or cam 19 being connected with the guide loop 4. This cam 19 slides in a rail that is not illustrated but pertains to the winch; the movement being in axial direction while the rail holds the the cam 19 against rotation, or transverse movement as far as the extension of the rail is concerned. The claw or cam 19 merges into the lower inclined entrance or passage way 23 which is connected to the guide loop 4 as is the upper inclined passage way 24. The connection between loop 4 and guide segment 6 is made by means of screws 25.

In order to save material and lower the weight recess chambers 20 are provided in the guide loop 4 as well as the guide segment 6. These recesses are situated opposite to the slot 3 and they are separated from each other by means of bars 21. The thinning of the walls for this purpose enhances of course also the elasticity and the resiliency of the part as a whole.

The invention is not limited to the embodiments described above but all changes and modifications thereof, not constituting departures from the spirit and scope of the invention, are intended to be included.

We claim:

1. In a rope drum arrangement a rope guide having a cam or claw to prevent the guide from following the rotation of the drum, comprising:

a guide segment looping around parts of the periphery of the drum and being provided with an inner threading;

a holding segment bolted to the guide segment and looping around a different portion of the drum and also being provided with an inner threading ;

a rope hold down device on the holding segment covering at least part of a single loop of rope on the drum and extending over several places for loops or rope on the drum, the threadings of the segments engaging the threadlike grooves of the drum so as to be moved in axial direction upon rotation of the drum;

a slot-forming guide loop element fastened to said guide segment through which a rope runs towards the periphery of the drum;

said segments and said slot forming element being made of synthetic material;

a mounting pin on the guide segment and in a position above said slot;

roller mounting means on said pin;

at least one roller with an axle journaled on the mounting means; and a spring for biasing said at least one roller, the bias being such that upon engagement of the rope by the roller the rope is forced towards the drum and into the groove thereof.

2. The rope guide as in claim 1 wherein said at least one roller, the hold down device and the guide element together encompass approximately the entire periphery of the drum, but covering less than the axial length of the drum.

3. The rope guide as in claim 1 wherein the ends of the guide segment and of the holding segment overlap, there being bores in both of them; and fastening means for interconnecting the two segments.

4. The rope guide as in claim 1, said guide segment and the guide element as disposed on both sides of the slot having inclined entrance ways for guiding the rope towards the drum.

5. The rope guide as in claim 1 said guide segment and said guide element having surfaces facing away from each other, there being recesses limited by bars in said surfaces in order to reduce the total material involved.

6. The rope guide as in claim 1 said mounting means on the guide segment being two roller mounts for mounting two rollers, the two mounts being arranged opposite said mounting pin.

7. The rope guide as in claim 6 wherein said roller mounts are U-shaped and carrying journal axles for mounting the rollers, there being axial space provided between the respective rollers and the walls of the roller mounts, permitting limited axial displacement of the rollers between the walls.

8. The rope guide as in claim 6 wherein said roller mounts are provided with support edges oriented towards each other, said spring bearing against that support edges.

9. The rope guide as in claim 1 wherein said guide cam merges in a lower entrance way of the slot for cooperating with an upper entrance limiter and providing a connection between the guide element and the guide segment, there being a screw inserted in said connection.

10. The rope guide as in claim 1 said synthetic material being polyamide with molybdenum disulfide added.

11. The rope guide as in claim 10 including a reinforcing angle piece made of steel and mounted on the guide element facing the slot and having a leg on the outside of the guide loop oriented away from the slot.

12. The rope guide as in claim 1 wherein said guide loop element, said at least one roller, said pin, said roller mounting means, said axle and said spring are made of steel the remaining part of the guide being made of a synthetic material.

13. The rope guide as in claim 12 wherein said at least one roller is hardened and mounted by means of roller bearings on said axle.

14. The rope guide as in claim 1 wherein the guide cam is made of synthetic material to obtain axial shifting of the rope guide as a whole vis-a-vis the drum as the drum rotates.

* * * * *